US006749953B1

(12) United States Patent
Sawatari et al.

(10) Patent No.: US 6,749,953 B1
(45) Date of Patent: Jun. 15, 2004

(54) WHISKERLESS GALVANIZED PRODUCT HAVING MULTI-LAYER RUST PREVENTION FILM AND MANUFACTURING METHOD OF WHISKERLESS GALVANIZED PRODUCT HAVING MULTI-LAYER RUST PREVENTION FILM

(75) Inventors: Akira Sawatari, Fukushima (JP); Ryouichi Muroi, Fukushima (JP); Takazumi Katano, Fukushima (JP); Eiki Mizuno, Fukushima (JP)

(73) Assignee: Sambix Corporation, Fukushima (JP)

( * ) Notice: Subject to any disclaimer, the term of this patent is extended or adjusted under 35 U.S.C. 154(b) by 120 days.

(21) Appl. No.: 10/031,780

(22) PCT Filed: Nov. 21, 2000

(86) PCT No.: PCT/JP00/08219

§ 371 (c)(1),
(2), (4) Date: Jan. 23, 2002

(87) PCT Pub. No.: WO02/42519

PCT Pub. Date: May 30, 2002

(51) Int. Cl.[7] ..... B32B 15/04; B32B 15/18; C25D 5/48; B05D 1/38; B05D 7/14

(52) U.S. Cl. ..... 428/658; 428/659; 428/457; 428/469; 205/220; 205/306; 427/406; 427/419.1

(58) Field of Search ..... 428/657, 658, 428/659, 627, 634, 680, 681, 650, 649, 674, 687, 457, 469, 470, 700; 205/220, 305, 306; 427/406, 409, 417, 418, 419–1

(56) References Cited

U.S. PATENT DOCUMENTS 4,385,096 A * 5/1983 Wetzel ..... 428/457
5,868,820 A * 2/1999 Claffey ..... 106/14.44
6,027,578 A * 2/2000 Marzano ..... 148/243
6,468,470 B1 * 10/2002 Oldsberg et al. ..... 422/15

FOREIGN PATENT DOCUMENTS

| | | |
|---|---|---|
| JP | 9-3684 | 1/1997 |
| JP | 2000-336497 | 12/2000 |
| JP | 2001-98392 | 4/2001 |

OTHER PUBLICATIONS

"Whisker Growth from Zinc Plating versus Chemical Species in Baths", Kaoru Ohkawara, et al., Hyomen Gijutsu, vol. 49, No. 5, (1998), pp. 78–82 (no month).

"Influence of Internal Stress and Crystal Structure on Whisker Growth from Zinc Plating", Kaoru Ohkawara, et al., Hyomen Gijutsu, vol. 51, No. 7, (2000), pp. 67–72 (no month).

* cited by examiner

*Primary Examiner*—Michael La Villa
(74) *Attorney, Agent, or Firm*—Weingarten, Schurgin, Gagnebin & Lebovici LLP

(57) ABSTRACT

A zinc whiskerless galvanized product has a multi-layer rust prevention film that provides excellent rust prevention, self-repair ability, and coating adhesion. A manufacturing method provides a zinc whiskerless galvanized product having the multi-layer rust prevention film. The multi-layer rust prevention film can be provided without the use of chemicals injurious to the environment such as sexivalent chrome. The multi-layer rust prevention film can be applied to various electronic components including computer equipment, communication equipment, or the like.

8 Claims, 3 Drawing Sheets

WHISKERLESS GALVANIZED PRODUCT HAVING MULTI-LAYER RUST PREVENTION FILM AND MANUFACTURING METHOD OF WHISKERLESS GALVANIZED PRODUCT HAVING MULTI-LAYER RUST PREVENTION FILM

FILED OF THE INVENTION

The present invention concerns a zinc whiskerless galvanized product having multi-layer rust prevention film having an excellent rust prevention, self-repair ability, and coating adhesion, a composition for forming multi-layer rust prevention film, and a manufacturing method of a zinc whiskerless galvanized product having multi-layer rust prevention film using the same.

BACKGROUND ART

Since electric and electronic components such as cover, case, chassis or other body of various components in a large electronics domain including computer equipment, communication equipment or the like require a high corrosion resistance, solderbility and electric properties, galvanization is recommended for these components, because it is strongly rust prevention in respect to the base material such as iron products, extremely excellent in corrosion resistance and cheap.

However, the galvanization has a problem that whiskers tend to be produced with time near the room temperature. The generation of zinc whisker short-circuits with counterpart components in a circuit or between terminals, provokes noise or deficient insulation, causes short-circuit troubles of electro-electronic components or the others, and more particularly, the zinc whisker generation increases short-circuit troubles along with the retrenchment of interval between components as electro-electronic components or the others are becoming smaller, high density, more complex, and low power.

The Inventors have examined diligently these problems and already proposed a lustrous galvanized product preventing completely the generation of zinc whisker for electro-electronic components and a lustrous galvanization method (Japan Patent Publication Laid-Open No. HEI 9-3684, Specifications of Japan Patent Application No. HEI 11-148183, "Hyomen Gijutsu Vol 49, No. 5 (1998), "Hyomen Gijutsu" Vol. 51, No. 7 (2000)9. The galvanized product presented problems of bad effects to human body and environmental pollution, as because it is surface-treated with chromate including sexivalent chrome for the purpose of surface protection or rust prevention.

On the other hand, the Inventors have already proposed a method for forming on a metal substrate a film presenting excellent rust prevention and self repair ability (Specification of Japan Patent Application No. HEI 11-272272) without using a treatment liquid containing sexivalent chrome; however, the formation of a coating by a further application of coating on a already formed film had a problem that the coating becomes less adhesive and peals off for some composition of rust prevention film.

DISCLOSURE OF THE INVENTION

The present invention has a first object of providing a galvanized product, wherein a galvanized film preventing completely the generation of zinc whisker on the surface of a metal substrate, and a multi-layer rust prevention film presenting not only rust prevention and self repair ability as excellent as the case of sexivalent chrome, but also an excellent coating adhesion, are formed on the surface of the galvanized film, without using chemicals such as injurious sexivalent chrome affecting the environment.

The present invention has a second object of providing a composition for multi-layer rust prevention film formation to obtain the composition for multi-layer rust prevention film easily.

Further, the present invention has a third object of providing a method for manufacturing easily the galvanized product of the present invention.

The Inventors have studied diligently in order to resolve problems of the related art, resulting in finding that the generation of zinc whisker can be prevent completely by the synergistic of galvanized film and multi-layer rust prevention films and, at the same time, a galvanized product excellent in rust prevention, self repair ability, and coating adhesion can be obtained by steps of forming closely a galvanized product wherein the generation of zinc whisker is prevented completely by galvanizing the surface of a metal substrate with a specific bath composition, thereafter, first of all, forming closely a first rust prevention film mainly containing tannic acid on the galvanized film, then forming closely a second rust prevention film containing mainly metal ions or the others on the upper portion of the first rust prevention film, and further, forming closely a third rust prevention film mainly containing tannic acid on the second rust prevention film, for leading to achieve the present invention.

In short, the present invention concerns a whiskerless galvanized product having a multi-layer rust prevention film, comprising a galvanized film formed closely on the surface of a metal substrate, presenting a lattice distortion of 0.02 to 0.35% of plated film measure by an X-ray diffractometer and carbon content of 0.01 to 0.07 mass % in plated film, a first rust prevention film mainly containing tannic acid formed closely on the galvanized film, a second rust prevention film containing mainly metal ions and/or metal compounds formed on the upper portion of the first rust prevention film, and a third rust prevention film mainly containing tannic acid on the second rust prevention film.

The present invention still further concerns the galvanized product described above, plated on the metal surface using a zinc cyanide bath whose caustic soda concentration is 50 to 160 g/L, zinc concentration is 10 to 30 g/L, a ratio of sodium cyanide concentration (g/L) to zinc concentration (g/L) to more than 3 and equal or inferior to 4, and to which a brightener is added.

The present invention still further concerns the galvanized product described above, wherein the metal substrate has a metal surface selected from a group comprising iron base material, or zinc, nickel, aluminum, magnesium, copper or alloys of two or more metals selected from these metals.

The present invention still further concerns the galvanized product described above, wherein the metal ion is a mixture of one or two species or more selected from Mo, V, Ti, W, Zr, while the metal compound is a mixture of one or two kinds or more of metal compounds containing these metals.

The present invention also concerns composition for multi-layer rust prevention film formation composed of a first treatment liquid containing tannic acid for forming the first rust prevention film and the third rust prevention film, and a second treatment liquid containing metal ions and/or metal compounds for forming the second rust prevention film.

The present invention further concerns composition for multi-layer rust prevention film formation described above, wherein the tannic acid concentration of the first treatment liquid is in a range of 0.1 to 30 g/L and pH is in a range of 3.5 to 8.0.

The present invention still further concerns the composition for multi-layer rust prevention film formation described above, wherein pH of the second treatment liquid is in a range of 2.0 to 10.0.

The present invention additionally concerns a manufacturing method of the galvanized product described above, comprising the following steps:

forming closely a galvanized film presenting a lattice distortion of 0.02 to 0.35% of plating film measured by an X-ray diffractometer and a carbon content of 0.01 to 0.07 mass % in plated film, by plating on the surface of a metal substrate using a zinc cyanide bath whose caustic soda concentration is 50 to 160 g/L, zinc concentration is 10 to 30 g/L, a ratio of sodium cyanide concentration (g/L) to zinc concentration (g/L) is more than 3 and equal or inferior to 4, and to which a brightener is added, and thereafter washing with water;

next, forming a first rust prevention film mainly containing tannic acid closely on the galvanized film by treating the galvanized film with a first treatment liquid containing tannic acid, and thereafter washing with water;

continuously, forming a second rust prevention film containing mainly metal ions and/or metal compounds on the upper portion of the first rust prevention film by treating with a second treatment liquid containing metal ions and/or metal compounds, and thereafter washing with water; and continuously, forming a third rust prevention film mainly containing tannic acid closely on the second rust prevention film by treating with the first treatment liquid containing tannic acid, and thereafter washing with water and drying.

Now, the present invention will be described in detail.

The metal substrate used for the present invention is a metal member for electro-electronic components or the others and includes mainly members made of steel base material; however, it is not limited to the same and can by applied largely to members required to be anti-corrosive, fro instance those having a metal surface selected from a group comprising zinc, nickel, aluminum, magnesium, copper or alloy of two or more metals selected from these metals.

The galvanized product of the present invention presents a lattice distortion of 0.02 to 0.35% of plated film measured by an X-ray diffractometer, preferably 0.02 to 0.32%, and more preferably 0.02 to 0.29% and a carbon content of 0.01 to 0.07 mass % in plated film, preferably 0.01 to 0.06 mass %, and more preferably 0.01 to 0.05 mass %.

The range indicated by oblique lines in FIG. 1 corresponds to the range of lattice distortion of 0.02 to 0.35% of the plated film and carbon content of 0.01 to 0.07 mass % in the plated film.

The generation of zinc whisker can be prevented completely, if the lattice distortion of the plated film and the carbon content in the plated film are within the range shown in FIG. 1.

In case of ordinary galvanization, the inclusion of eutectoid impurities such as carbon at the zinc crystalline interface provokes distortion in the surrounding metal lattice and increases the internal stress due to the electro-deposition.

It is inferred that when the internal stress in the galvanized film becomes equal or superior to a certain value, hillocks begin to appear from the surface, and thereafter, the root is supplied with zinc atoms one after another and they grow into whiskers. It goes without saying that the idea is not limitative. Within the range of carbon content and lattice distortion, whiskers do not appear.

Whiskers appear when the lattice distortion of the plated film exceeds 0.35%. On the other hand, the smaller is the lattice distortion of the plated film, the lesser whiskers appear, which is preferable; however, in practice, it is difficult to limit the lattice distortion of the plated film less than 0.02%, for instance by changing the plating conditions such as current density, bath temperature or the others, without using a brightener.

Whiskers appear when the carbon content exceeds 0.07 mass %. On the other hand, the lower is the carbon content, the lesser whiskers appear, which is preferable; however, in practice, it is difficult to limit the carbon content less than 0.01 mass %, for instance by changing the plating conditions such as current density, bath temperature or the others, without using a brightener.

In the present invention, the lattice distortion of the plated film is determined from each peak area and each peak position of five (5) zinc diffraction lines [100], [101], [110], [200] and [201] obtained using an X-ray diffractometer, by a method described in JEOL Application Note XR-23, SAKAMAKI Toshio, "Principle and Application of X-ray diffraction method", 1992, Nihon Denshi, Co., Ltd., p. 163.

Namely, in the present invention, the lattice distortion of the plated film $\eta$ is obtained from the Y-axis section of a straight line passing through 5 points when integral widths $\beta\mathbf{1}$ to $\beta\mathbf{5}$ and Bragg angles $\theta\mathbf{1}$ to $\theta\mathbf{5}$ of five (5) zinc diffraction lines [100], [101], [110], [200] and [201] obtained using an X-ray diffractometer are measured, and $\beta\mathbf{2}/\tan\mathbf{2}\theta$ is plotted on the T-axis and $\beta/\tan\theta\sin\theta$ on the X-axis, in the following expression (1):

$$\beta\mathbf{2}+\tan\mathbf{2}\,\theta\lambda/\epsilon\times\beta/\tan\theta\sin\theta+\eta\mathbf{2} \qquad \text{expression (1)}$$

The carbon content in the plated film is the present invention is the one obtained by measuring preliminarily the zinc quantity ratio (Zn/Fe +Zn) in a sample by using an inductively coupled high frequency plasma emission spectroscope, measuring the carbon quantity in the sample by using a carbon/sulfur analyzer, and by dividing the carbon quantity with the zinc quantity ratio.

In the present invention, a zinc cyanide plating bath containing caustic soda and sodium cyanide can be used advantageously. The use of zinc cyanide plating bath desmuts (metal oxide) effectively the metal member to be plated, the plating becomes uniform, and lustrous electro-electronic components preventing zinc whisker from generating and presenting excellent luster, corrosion resistance or the others can be produced constantly in a industrial mass production scale.

The caustic soda concentration used preferably in the present invention is in a range of 50 to 160 g/L, preferably 60 to 120 g/L and more preferably 75 to 90 g/L.

If the caustic soda concentration is less than 50 g/L, the electric deposition rate lowers, the positive pole zinc becomes inactive, the bath temperature elevates decreasing the luster, the inactivation of positive pole zinc soils the bath and the surface becomes rough, or the other problems may happen. If the caustic soda concentration exceeds 160 g/L, the positive pole zinc dissolves excessively, the brightener tends to decompose easily, chemicals become uneconomic, liquid-waste imposes a burden, or the other problems may happen.

Zinc concentration in the zinc cyanide plating bath used preferably in the present invention is in a range of 10 to 30 g/L, preferably 10 to 25 g/L and more preferably 10 to 20 g/L.

If the zinc concentration is less than 10 g/L, it is feared that the electric deposition rate lowers. If the zinc concentration exceeds 30 g/L, he throwing power decreases, the consumption in sodium cyanide increases to maintain the prescribed M ratio, or the other problems occur.

The M ratio of the zinc cyanide plating bath used preferably in the present invention exceeds 3 and is equal or less than 4, preferably in a range of 3.2 to 4, and more preferably 3.2 to 3.6.

If the M ratio is 3 or less, it is feared that whisker appears easily. If the M ratio exceeds 4, the consumption in sodium cyanide increases, the electric deposition rate lowers, chemicals become uneconomic, liquid-waste imposes a burden, the surface of plated product becomes rough or the other problems may happen.

The sodium cyanide concentration of the zinc cyanide plating bath used in the present invention can be determined by calculation, one the zinc concentration and M ratio are decided.

FIG. 2 indicates the range (portion indicated by oblique lines) of sodium cyanide concentration and caustic soda concentration of the zinc cyanide plating bath used in the present invention, FIG. 3 indicates the range (portion indicated by oblique lines) of zinc concentration and sodium cyanide concentration of the zinc cyanide plating bath used in the present invention (M ratio is indicated in FIG. 3. M ration in the present invention exceeds 3 and is equal or inferior to 4), while FIG. 4 indicates the range (portion indicated by oblique lines) of zinc concentration and caustic soda concentration of the zinc cyanide plating bath used in the present invention.

As brightener used in the present invention, publicly known inorganic compounds such as nickel salt, cobalt salt or the others, and organic compounds such as peptone, polyvinyl alcohol, gelatin, heliotropin, coumarin, glue, thiurea, vanillin, formaldehyde resin, piperonal or the others can be used solely or by combination, and their addition amount can be used optimally on the order of 0.5 to 5 g/L which is a range used normally.

For galvanizing in the aforementioned range of bath composition, the galvanized film thickness is not specially limited, but is preferably on the order of 2 to 20 $\mu$m. If the film thickness is less than 2 $\mu$m, the corrosion resistance decreases, and when it exceeds 20 $\mu$m, the productivity drops dramatically, which is not desirable.

In the present invention, it is essential to form closely a galvanized product wherein the generation of zinc whisker is prevented completely by galvanizing the surface of a metal substrate as mentioned above, thereafter, first of all, form closely a first rust prevention film mainly containing tannic acid on the galvanized film, then form closely a second rust prevention film containing mainly metal ions or the others on the upper portion of the first rust prevention film, and further, form closely a third rust prevention film mainly containing tannic acid on the second rust prevention film, for leading to achieve the present invention.

FIG. 5 is an illustration view showing schematically the cross section of the galvanized product of the present invention having a multi-layer rust prevention film.

In FIG. 5, a galvanized product 1 of the present invention comprises a galvanized film 3, wherein the generation of zinc whisker is prevented completely, formed closely on the surface of a metal substrate 2, a first rust prevention film 4 mainly containing tannic acid formed closely on the surface of the galvanized film 3, a second rust prevention film 5 containing mainly metal ion and/or metal compound formed on the upper portion thereof including the surface of the first rust prevention film 4, and a third rust prevention film 6 mainly containing tannic acid formed closed on the surface of the second rust prevention film 5.

The tannic acids used in the present invention are gallotannic acids having a complicated molecular structure taking polyoxyphenyl as basic structure and are not necessarily pure, and rude ones are called tannin. To be more specific, for instance, depside, Chinese tannin, Turkish tannin, hamamelis tannin, smactannin, cheprin adid, gall tannin, ellagic acid tannin, catechin, catechu, Gambian, quebracho tannin, or mixture of one or two or more of them can be cited.

In the present invention, commercialized tannic acids can be used.

The metal ion is a mixture of one or two species or more selected from Mo, V, Ti, W, Zr, while the metal compound is a mixture of one or two kinds or more of metal compounds containing these metals.

As the metal compound, to be more specific, for instance, a mixture of one or two or more of compound molybdate, compound vanadate, compound titanate, compound tungstate, compound zirconate or the others metal compounds, metal compounds containing the metals, and fluorine metal compound containing the metals can be cited.

As the compound molybdate, for example, ammonium molybdate, sodium molybdate or the like can be used.

As the compound vanadate, for example, ammonium vanadate, sodium vanadate or the like can be used.

As the compound tungstate, for example, ammonium tungstate, sodium tungstate or the like can be used.

As the compound titanate, or compound zirconate, for instance, similarly, in addition to various alkali metal salts, halides can also be used.

In order to form the first rust prevention film 4 containing mainly tannic acid shown in FIG. 5 closely on the surface of the galvanized film 3, first, the surface of the galvanized film 3 is treated with a first treatment liquid containing tannic acid.

Concentration and pH of the tannic acid of the first treatment liquid is not particularly specified; however, the tannic acid concentration of the first treatment liquid is preferably in a range of 0.1 to 30 g/L and more preferably 0.5 to 25 g/L, while pH is preferably in a range of 3.5 to 8.0 and more preferably 4.0 to 7.0.

If the tannic acid concentration is less than 0.1 g/L, a tannic acid film presenting a satisfactory corrosion resistance might not be obtained, and if it exceeds 30 g/L, better effects can not be expected in terms of treatment time reduction or rust prevention performance.

On the other hand, the temperature of the first treatment liquid is preferably from about 10 to 50° C. If it is lower than 10° C., the reaction rate might be slow, and a sufficient film might not be formed, while if it exceeds 50° C., organic substances might decompose and, moreover, much treatment liquid will evaporate uneconomically. Furthermore, the treatment time with the first treatment liquid is preferably about 15 to 180 sec. If it is less than 15 sec, the rust prevention film might not be formed satisfactorily, and even if it exceeds 180 sec, better effects can not be expected in terms of treatment concentration reduction or rust prevention performance.

If pH of the first treatment liquid is less than pH 3.5 or more than pH 8.0, the formed rust prevention film may dissolve again easily.

The pH of the first treatment liquid can be adjusted using alkali substances or acid substances. Alkali substances for pH adjustment includes, for example, sodium hydroxide, potassium hydroxide, ammoniac water, various amines, various amino alcohols, organic acid salts, organic carboxilates, organic amine compounds or the others, and acid substances include hydrochloric acid, sulfuric acid, nitric acid, phosphoric acid, hydrofluoric acid, formic acid, acetic acid, organic acid, organic carboxylic acid or other.

The thickness of the first rust prevention film 4 obtained by treating with the first treatment liquid is not particularly specified. However, by treating under the aforementioned treatment conditions, a first rust prevention film 5 having a thickness of the order of about 0.05 to 0.3 μm adhered closely to the galvanized film 3 can be obtained.

Next, in order to form a second rust prevention film 5 on the upper portion including the surface of thus formed first rust prevention film 4, immediately after the treatment with the first treatment liquid, preferably after substantially washing out the first treatment liquid from the top of the first rust prevention film 4 by washing with water after the treatment with the first treatment liquid, the surface of the first rust prevention film 4 is treated with a second treatment liquid containing metal ions and/or metal compounds.

The pH of the second treatment liquid is not particularly specified; however, pH is preferably in a range of 2.0 to 10.0 and more preferably, it is adjusted from 3.5 to 8.0. If pH of the second treatment liquid is less than pH 2.0 or more than pH 10.0, the formed rust prevention film may dissolve again easily.

The content of metal ions and/or metal compounds in the second treatment liquid is not particularly specified; however, the content converted into metal ion is preferably 0.01 to 50 g/L, and more particularly, 0.1 to 30 g/L. If it is lower than 0.01 g/L, the rust prevention might be reduced, while even if it exceeds 50 g/L, the rust prevention would not be improved, becoming uneconomic.

The pH of the second treatment liquid can be adjusted using acid substances or alkali substances. Alkali substances for pH adjustment includes, for example, sodium hydroxide, potassium hydroxide, lithium hydroxide, ammoniac water, or the others, and acid substances include hydrochloric acid, sulfuric acid, nitric acid, phosphoric acid, hydrofluoric acid, formic acid, acetic acid, organic acid, organic carboxylic acid or other.

The treatment temperature by the second treatment liquid is preferably on the order of about 10 to 60° C., and preferably about 15 to 50° C. If it is lower than 10° C., the reaction rate of absorption, sorption, or chemical bonding of metal ions to the tannic acid film might be slow, and a sufficient corrosion resistance might not be formed, while if it exceeds 60° C., much treatment liquid will evaporate uneconomically. Furthermore, the treatment time with the second treatment liquid is about 5 to 180 sec, and preferably, about 10 to 150 sec. If it is less than 10 sec, the rust prevention film might not be formed sufficiently, and even if it exceeds 150 sec, better effects can not be expected in terms of treatment concentration reduction or rust prevention performance.

In addition to metal ion or/and metal compound, oxidant, reducer, chelating agent or other publicly known additives can be added to the second treatment liquid as stabilizer in the treatment liquid of metal ion.

The thickness of the second rust prevention film 5 obtained by treating with the second treatment liquid is not particularly specified; however, by treating under the aforementioned treatment conditions, a second rust prevention film 5 having a thickness of the order of about 0.05 to 0.3 μm can be obtained at the upper portion including the surface of the first rust prevention film 4.

Then, in order to form a third rust prevention film 6 on the surface of thus formed second rust prevention film 5, immediately after the treatment with the second treatment liquid, preferably after substantially washing out the second treatment liquid from the top of the second rust prevention film 5 by washing with water after the treatment with the second treatment liquid, the surface of the second rust prevention film 5 is treated similarly with the first treatment liquid having the same composition as the aforementioned or a different composition. Upon formation of the third rust prevention film 6, it is washed with water and dried to obtain the galvanized product 1 of the present invention.

The thickness of the third rust prevention film 6 obtained by treating with the first treatment liquid having the same composition as mentioned above or a different composition is not particularly specified. However, by treating under the aforementioned treatment conditions, a third rust prevention film 6 having a thickness of the order of about 0.05 to 0.3 μm adhered closely to the second rust prevention film 5 can be obtained.

The thickness of the multi-layer rust prevention film formed on the metal substrate 2 is not particularly specified. However, by treating under the aforementioned treatment conditions, a multi-layer rust prevention film having a thickness of the order of about 0.02 to 0.8 μm and excellent rust prevention and coating adhesion can be obtained.

As the galvanized product of the present invention is excellent in coating adhesion, its surface can be painted as necessary for the purpose of bestowing decoration or functionality. Concerning the kind of painting, commercialized non reticulated type paintings such as nitrocellulose or vinyl base resin, or commercialized reticulated type paintings such as alkyd resin, melamine alkyd resin, unsaturated polyester resin, epoxy resin, urethane resin or thermosetting acrylic resin; however, reticulated type paintings are preferable in respect of chemical resistance, abrasion resistance or the others, and they can be reticulated using an ordinary setting method such as heat, UV, far infrared, electronic beam or the others. Among other reticulating type resins, melamine alkyd resin can be used particularly advantageously because it can be baked at a low temperature in a short period of time, and present excellent coating hardness, luster, weather resistance, chemical resistance, abrasion resistance, incombustibility, electric characteristics, and close adhesion.

The coating method is not particularly limited, and a coating firmly adhered to the third rust preventive film 6 can be formed by an ordinary method such as brushing, soaking, roller coating, flow coating or the like.

The galvanized product 1 of the present invention shown in FIG. 5 prevents completely zinc whisker from generating, presenting excellent rust prevention and coating close adhesion and, at the same time, even when the multi-layer rust prevention film be damaged and the galvanized film 3 and the metal substrate 2 be exposed, the scar would be supplied with metal ion and/or metal compound in the second rust prevention film 5, covering the scar, preventing rust, and thus maintaining the rust prevention.

BEST MODE FOR CARRYING OUT THE INVENTION

Figure 1:
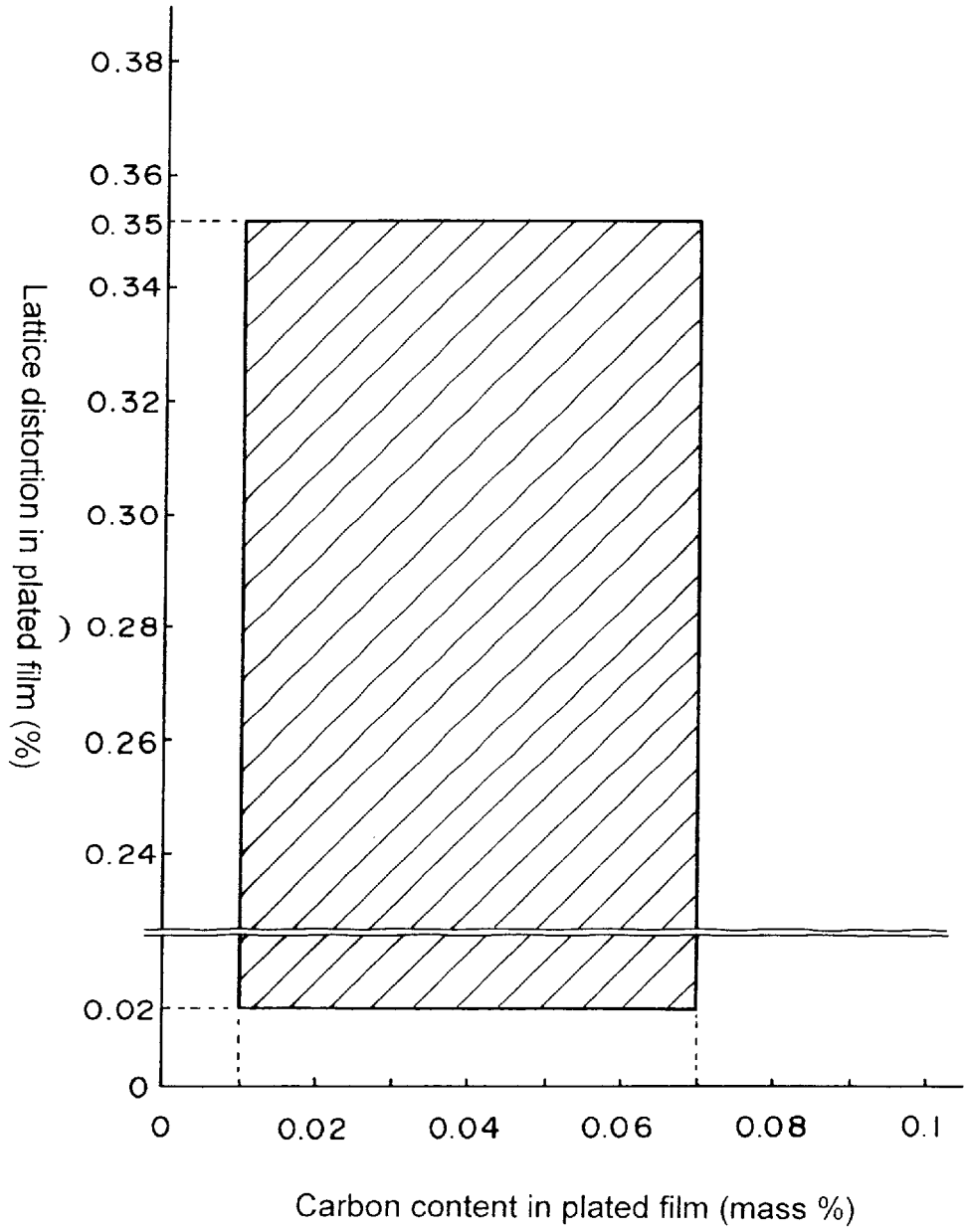
FIG. 1 is a graph showing the lattice distortion of the plated film specified by the present invention and the range of carbon content in the plated film.
Figure 2:
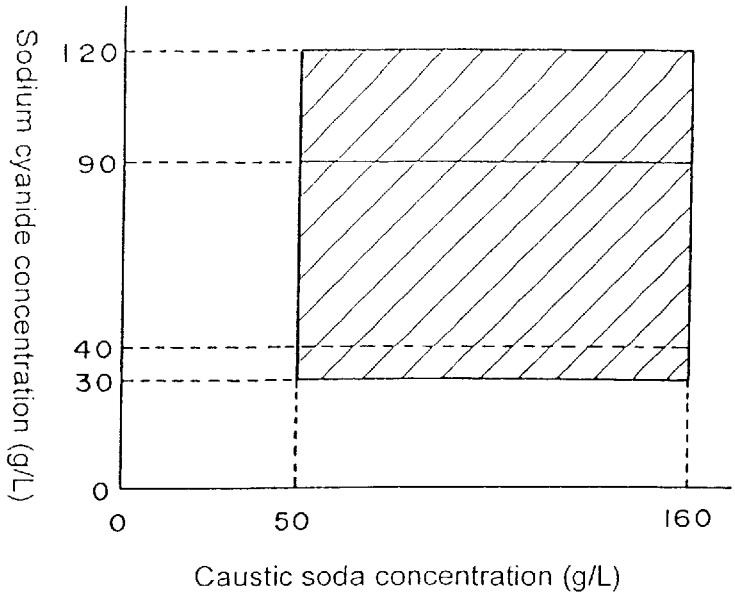
FIG. 2 is a graph showing the sodium cyanide concentration of zinc cyanide bath and the range of caustic soda concentration to be used in the present invention.
Figure 3:
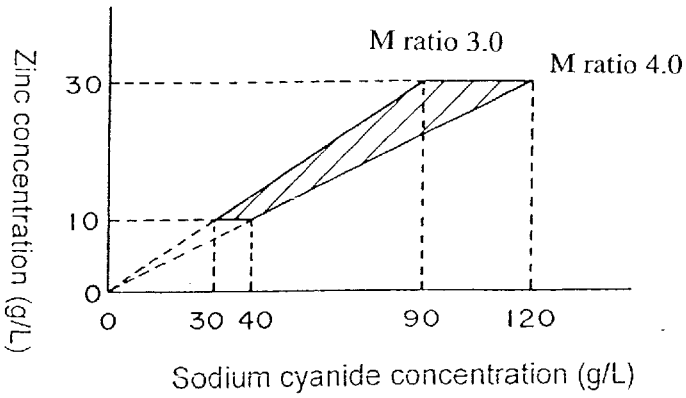
FIG. 3 is a graph showing the zinc concentration of zinc cyanide bath and the range of sodium cyanide concentration to be used in the present invention.
Figure 4:
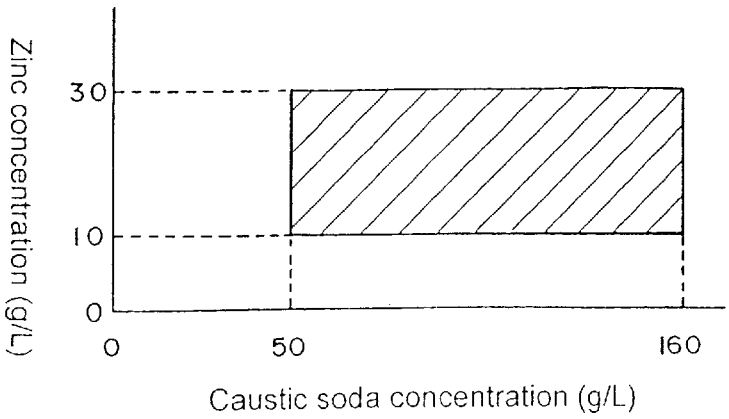
FIG. 4 is a graph showing the zinc concentration of zinc cyanide bath and the range of caustic soda concentration to be used in the present invention.
Figure 5:
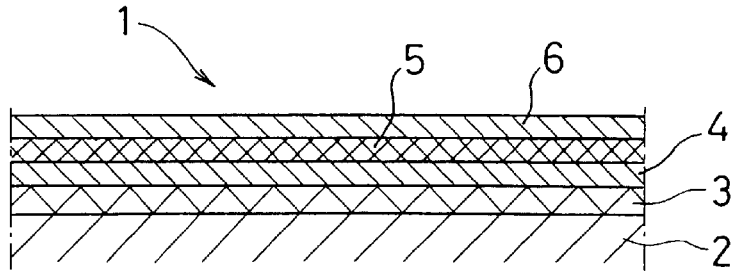
FIG. 5 illustrates schematically a cross section of the galvanized product of the present invention having a multi-layer rust prevention film, 1 indicates a galvanized product of the present invention, 2 a metal substrate, 3 a galvanized film, 4 a first rust prevention, 5 a second rust prevention film, and 6 a third rust prevention film.

Now, the present invention will be described more in detail referring to embodiments; however, the present invention should not be limited to these embodiments.

EMBODIMENT 1

A SPCC steel plate (100×50×1.0 mm) is degreased sufficiently in an alkali degreaser and washed, then the oxide film is solved and removed in a hydrochloric acid of 8 volume % and washed sufficiently with water. A preliminarily treated substrate is galvanized with a plated film of 8 to 12 $\mu$m in thickness using a lustrous galvanization bath have a bath composition shown in Table 1 [NaOH (concentration 75 g/L), NaCN (concentration 80 g/L), Zn (concentration 25 g/L), brightener (made by Nippon Hyomen Kagaku Co., Ltd., commercial name; Brightener "J11114") 3 g/L] under the bath condition of 30° C. in bath temperature and 3A/dm2 in current density. Lattice distortion and carbon quantity that are plated film characteristics of the same were measured as follows.

Lattice Distortion Measurement

The lattice distortion of the plated film was determined using a X-ray diffractometer [made by Nihon Denshi Corporation, JDX-3500]. It was found to be 0.271% or within the range of the present invention.

(Carbon Quantity Measurement)

The carbon content in the plated film was determined by measuring the zinc quantity ratio in a sample using an inductively coupled high frequency plasma emission spectroscope [made by RIGAKU CO., LTD., JY170ULTRCE], measuring the carbon quantity in the sample by using a carbon/sulfur analyzer [Horiba Seisakusho Corporation, EMIA3200] and by dividing the carbon quantity by the zinc quantity ratio. It was found to be 0.03 mass % or within the range of the present invention.

Next, it was soaked and treated in a first treatment liquid (tannic acid content 5 g/L) of the composition for multi-layer rust prevention film formation of the present invention on the galvanized film at 25° C. for 30 sec, and washed with water Continuously, it was soaked and treated in a second treatment liquid (V ion content 10 g/L) of the composition for multi-layer rust prevention film formation of the present invention at 25° C. for 60 sec and then washed with water.

Again, it was soaked and treated in a first treatment liquid (tannic acid content 5 g/L) at 25°C. for 60 sec, washed with water, and dried at 60° C. for 10 min to obtain the galvanized product of the present invention.

(Whisker Generation Test)

Thus obtained galvanized product of the present invention having a multi-layer rust prevention film was left for 3 days in a thermostat chamber of 100° C., the generation or not of whisker was observed by a scanning electron microscope or stereoscopic microscope with an appropriate magnification, and the absence of zinc whisker generation was evaluated as ○ and the generation of zinc whisker as X. The results are shown in Table 1, and no generation of zinc whisker was observed.

(Salt Spray Test)

A salt spray test based on JIS-2371 was performed in order to evaluate the corrosion resistance of the galvanized product of the present invention after the whisker generation test. As for the evaluation method, it was evaluated with the time of generation of white rust on the test piece and the time until the area of white rust generation (proportion of the total white rust generation area to the whole area of the test piece). The results are shown in Table 1, and they were respectively 96 hours and 168 hours, proving an excellent rust resistance.

(Evaluation of Self Repair Ability by Salt Spray Test)

Times up to generation of white rust in the aforementioned salt spray test were contrasted for the case of not crosscutting a galvanized product of the present invention having a multi-layer rust prevention film not submitted to the whisker generation test and for the case of crosscutting the same, and it was evaluated as ○ when the time until white rust generation of the case of crosscutting exceeds the time until white rust generation of the case of not crosscutting by 50% or more, and similarly, it was evaluated as X when less than 50%. The results are shown in Table 1, showing an excellent self repair ability.

(Coating Adhesion Test)

Epoxy primer made by DAINIHON TORYO Co., Ltd. was applied to a galvanized product of the present invention having a multi-layer rust prevention film not submitted to the whisker generation test, baked at 150° C. for 20 min, and melamine alkyd resin painting SG2093 made by Nippon Paint Co., Ltd. is applied and baked at 150° C. for 20 min and one hundred (100) squares were cut on the sample with a cutter knife, a Scotch tape was stuck and pealed off suddenly, and the number of pealed off squares was counted. The result was shown by 0/100 if no square was pealed off, and 55/100 if 55 squares were pealed off. The results are shown in Table 1, showing an excellent adhesion to the coating.

(XPS Analysis)

XPS analysis of the multi-layer rust prevention film of a galvanized product of the present invention having a multi-layer rust prevention film not submitted to the whisker generation test was carried out under the following conditions.

| | |
|---|---|
| Analysis method | Analysis in the depth direction by x-ray photoemission spectroscopy (XPS) |
| Equipment | PHI-5400MC (Parkin-Elma Inc.) |
| XPS measurement | |
| Vacuum degree | 1 × 107 Pa |
| X-ray source | Aluminum (Kα) 1486.7 eV<br>Monochromated by Monochromator<br>15 KV 300 W |
| Etching | Argon ion beam<br>4 KV, 25 mA<br>Argon 5 mPa |

For the analysis in the depth direction, (1) argon etching 60 sec, (2) XPS measurement (carbon, oxygen, zinc, vanadium) have been repeated for the composition analysis in the depth direction. It should be appreciated that zinc has derived from the plated film, carbon from the rust prevention film containing mainly tannic acid, oxygen from tannic acid and vanadium compound, and vanadium from the rust prevention film containing mainly metal ions or the like.

Figure 6:
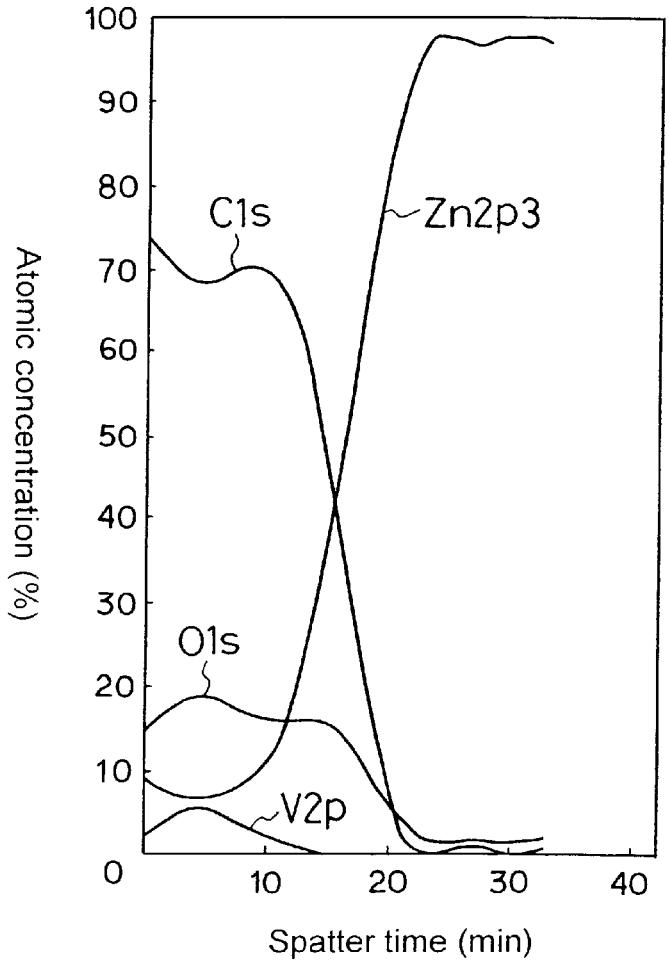
FIG. 6 is a graph showing the result of x-ray photoemission spectroscopy (XPS analysis) of the surface of the galvanized product of the present invention having a multi-layer rust prevention film.

The results of XPS analysis are shown in FIG. 6. In FIG. 6, the axis of ordinate indicates the atomic concentration (%), and the axis of abscissa the spatter time (min). 1 min of spatter time corresponds to 5 n μm(thickness).

In FIG. 6, C1S is a curve showing the atomic concentration of carbon, O1S oxygen, Zn2P3 zinc, and V2P vanadium, respectively.

In FIG. 6, carbon peaks are identified around 0 min (surface layer) and 10 min of spatter time, and a peak of vanadium is recognized near 5 min, at the middle of them, showing that the multi-layer rust prevention film of the present invention has been formed.

EMBODIMENTS 2 to 5

Characteristics of plated film were measured and performances of the plated product were evaluated same as the embodiment 1 except for using a bath composition shown in Table 1 and first to second treatment liquids of the present invention, and results there of are shown in Table 1 collectively.

Comparative Examples 1 to 8

Characteristics of plated film were measured and performances of the plated product were evaluated same as the embodiment 1 except for using a bath composition and rust prevention liquids shown in Table 2, and results there of are shown in Table 2 collectively.

TABLE 1

| | | | Embodiment 1 | Embodiment 2 | Embodiment 3 | Embodiment 4 | Embodiment 5 |
|---|---|---|---|---|---|---|---|
| Bath composition | NaOH (g/l) | | 75 | 75 | 75 | 75 | 75 |
| | NaCN (g/l) | | 80 | 80 | 80 | 80 | 54 |
| | Zn (g/l) | | 25 | 25 | 25 | 25 | 15 |
| | Brightener (g/l) | | 3 | 3 | 3 | 3 | 3 |
| Film treatment | First treatment liquid Tannic acid | | 5 | 2 | 5 | 2 | 2 |
| | Second treatment liquid Metal ion | | V10 | V10 | Mo10 | Mo10 | V10 |
| | First treatment liquid Tannic acid | | 5 | 5 | 10 | 2 | 2 |
| Plated film characterization | Lattice distortion (%) | | 0.271 | 0.271 | 0.271 | 0.271 | 0.150 |
| | Carbon quantity (mass %) | | 0.030 | 0.030 | 0.030 | 0.030 | 0.010 |
| Results of galvanized product performance evaluation | Whisker generation test | | ○ | ○ | ○ | ○ | ○ |
| | Salt spray test | White rust generation | 96 | 72 | 72 | 72 | 72 |
| | | 5% white rust | 168 | 144 | 144 | 120 | 144 |
| | | Self repair | ○ | ○ | ○ | ○ | ○ |
| | Coating adhesion test | | 0/100 | 0/100 | 0/100 | 0/100 | 0/100 |

TABLE 2

| | | | Comparative | Comparative | Comparative | Comparative | Comparative | Comparative | Comparative | Comparative |
|---|---|---|---|---|---|---|---|---|---|---|
| Bath composition | NaOH (g/l) | | 75 | 75 | 90 | 75 | 75 | 75 | 75 | 75 |
| | NaCN (g/l) | | 80 | 54 | 30 | 60 | 80 | 80 | 80 | 80 |
| | Zn (g/l) | | 25 | 15 | 15 | 25 | 25 | 25 | 25 | 25 |
| | Brightener (g/l) | | 3 | 3 | 3 | 3 | 3 | 3 | 3 | 3 |
| Film treatment | First treatment liquid Tannic acid | | 5 | 2 | 5 | 5 | 5 | — | 5 | — |
| | Second treatment liquid Metal ion | | Ni10 | Zn5 | V10 | Mo10 | V10 | V5 | — | V5 |
| | First treatment liquid Tannic acid | | 5 | 5 | 10 | 2 | 2 | | | |
| Plated film characterization | Lattice distortion (%) | | 0.271 | 0.150 | 0.399 | 0.399 | 0.271 | 0.271 | 0.271 | 0.271 |
| | Carbon quantity (mass %) | | 0.030 | 0.010 | 0.108 | 0.108 | 0.030 | 0.030 | 0.030 | 0.030 |
| Results of galvanized product performance evaluation | Whisker generation test | | ○ | ○ | x | x | ○ | ○ | ○ | ○ |
| | Salt spray test | White rust generation | 72 | 48 | 24 | 24 | 72 | 24 | 12 | 2 |
| | | 5% white rust | 120 | 72 | 36 | 36 | 144 | 36 | 24 | 4 |
| | | Self repair | x | x | ○ | ○ | ○ | x | x | x |
| | Coating adhesion test | | 0/100 | 0/100 | 0/100 | 0/100 | 55/100 | 4/100 | 20/100 | 0/100 |

From Table 1, it can be understood that all of gavanized products of the embodiments 1 to 5 treated with the first treatment liquid—second treatment liquid—first treatment liquid after galvanization do not generates zinc whisker, present an excellent rust prevention, and at the same time, maintain rust prevention even when the multi-layer rust prevention film is damaged, and have also an excellent coating adhesion.

In contrast, the galvanized product of the comparative example 1 of Table 2 prepared similarly as the embodiment 1 except for using Ni ion as metal ion, does not generates zinc whisker and has an excellent rust prevention. However, it can be understood that the rust prevention deteriorates when the multi-layer rust prevention film is damaged, and the self repair ability is mediocre.

Also, it can be understood that the galvanized product of the comparative example 2 prepared similarly as the embodiment 5 except for using Zn ion as metal ion, does not generates zinc whisker, presents an excellent coating adhesion, but are poor in rust prevention and self repair ability.

The galvanized product of the comparative example 3 prepared similarly as the embodiment 1 except for using a bath composition out of the scope of the present invention for galvanization is excellent in self repair ability and coating adhesion, but generates zinc whisker, because of important lattice distortion and carbon quantity of the galvanized film, deteriorating the rust prevention.

The galvanized product of the comparative example 4 prepared practically similarly as the embodiment 3 except for using a bath composition out of the scope of the present invention for galvanization is excellent in self repair ability and coating adhesion, but generates zinc whisker, because of important lattice distortion and carbon quantity of the galvanized film, deteriorating the rust prevention.

The galvanized product of the comparative example 3 prepared similarly as the embodiment 1 except for using a bath composition out of the scope of the present invention for galvanization does not generates zinc whisker, presents excellent rust prevention and self repair ability; however, it can be understood that its coating adhesion is poor.

The galvanized product of the comparative example 6 prepared similarly as the embodiment 1 except for absence of the first rust prevention film formation, does not generates zinc whisker, however, it can be understood that its coating adhesion is relatively poor, and rust prevention and self repair ability are mediocre.

The galvanized product of the comparative example 7 prepared similarly as the embodiment 1 except that only the first rust prevention film is formed and the second and the third rust prevention films are not formed, does not generates zinc whisker, however, it can be understood that its coating adhesion, rust prevention and self repair ability are mediocre.

The galvanized product of the comparative example 8 prepared similarly as the embodiment 1 except that only the second rust prevention film is formed but the first rust prevention film and the third rust prevention films are not formed does not generates zinc whisker and presents a good coating adhesion, however, it can be understood that its rust prevention and self repair ability are mediocre.

INDUSTRIAL APPLICABILITY

As electric and electronic components such as cover, case, chassis or the other body of various components in a large electronics domain including computer equipment, communication equipment or the like require a high corrosion resistance, solderbility and electric properties, galvanization is recommended for these components, because it is strongly rust prevention in respect to the base material such as iron products, extremely excellent in corrosion resistance and cheap; however, the galvanization has a problem that whiskers tend to be produced with time near the room temperature. The generation of zinc whisker short-circuits with counterpart components in a circuit or between terminals, provokes noise or deficient insulation, causes short-circuit troubles of electro-electronic components or the others, and more particularly, the zinc whisker generation increases short-circuit troubles along with the retrenchment of interval between components as electro-electronic components or the others are becoming smaller, high density, more complex, and low power.

As the galvanized product of the present invention is a galvanized product, wherein a galvanized film preventing completely the generation of zinc whisker is formed on the surface of a metal substrate, and a multi-layer rust prevention film presenting not only rust prevention as excellent as the case of sexivalent chrome, but also maintaining the rust prevention even if the rust prevention film is damage and, at the same time, presenting an excellent coating adhesion, is formed on the surface of the galvanized film, without using chemicals such as injurious sexivalent chrome affecting the environment, it can be applied to various components in a large electronics domain including computer equipment, communication equipment or the like as mentioned above, and its industrial utility is considerably high.

We claim:

1. A whiskerless galvanized product having a multi-layer rust prevention film, comprising a galvanized film, formed to adhere strongly on a surface of a metal substrate, having a lattice distortion of 0.02 to 0.35% of plated film measured by an X-ray diffractometer and a carbon content of 0.01 to 0.07 mass % in plated film, a first rust prevention film mainly containing tannic acid and formed to adhere strongly on the surface of said galvanized film, a second rust prevention film containing mainly metal ions and/or metal compounds formed on an upper portion of said first rust prevention film, and a third rust prevention film mainly containing tannic acid and formed to adhere strongly on said second rust prevention film.

2. The galvanized product of claim 1, wherein said metal substrate has a surface of a metal selected from the group consisting of iron base material, zinc, nickel, aluminum, magnesium, copper and alloys of two or more metals selected from the group consisting of zinc, nickel, aluminum, magnesium, and copper.

3. The galvanized product of claim 1, wherein said metal ion is selected from the group consisting of Mo, V, Ti, W, Zr, and a mixture of two species or more selected from the group consisting of Mo, V, Ti, W, and Zr, while said metal compound contains a metal selected from the group consisting of Mo, V, Ti, W, Zr and mixture of two kinds or more of metals.

4. The galvanized product of claim 1, wherein each of said at least one metal compound comprises a metal selected from the group consisting of Mo, V, Ti, W, and Zr.

5. The galvanized product of claim 1, plated on the surface of the metal substrate using a zinc cyanide bath of which caustic soda concentration is 50 to 160 g/L, zinc concentration is 10 to 30 g/L, a ratio of sodium cyanide concentration (g/L) to zinc concentration (g/L) is more than 3 and equal or inferior to 4, and to which a brightener is added.

6. The galvanized product of claim 5 wherein:

said metal substrate has a surface of a metal selected from the group consisting of iron base material, zinc, nickel, aluminum, magnesium, copper and alloys of two or more metals selected from the group consisting of zinc, nickel, aluminum, magnesium, and copper; and said metal ion is selected from the group consisting of Mo, V, Ti, W, Zr and a mixture of two species or more selected from the group consisting of Mo, V, Ti, W, and Zr, while said metal compound contains a metal selected from the group consisting of Mo, V, Ti, W, Zr, and a mixture of two kinds or more of these metals.

7. The galvanized product of claim 5, wherein:

said metal substrate has a surface of a metal selected from the group consisting of iron base material, zinc, nickel, aluminum, magnesium, copper and alloys of two or metals selected from the group consisting of zinc, nickel, aluminum, magnesium, and copper; and each of said at least one metal compound comprises a metal selected from the group consisting of Mo, V, Ti, W, and Zr.

8. A manufacturing method of a galvanized product having a multi-layer rust prevention film, comprising a galvanized film, formed to adhere strongly on a surface of a metal substrate, having a lattice distortion of 0.02 to 0.35% of plated film measured by an X-ray diffractometer and a carbon content of 0.01 to 0.07 mass % in plated film, a first rust prevention film mainly containing tannic acid and formed to adhere strongly on the surface of said galvanized film, a second rust prevention film an containing mainly metal ions and/or metal compounds formed on upper portion of said first rust prevention film, and a third rust prevention film mainly containing tannic acid and formed to adhere strongly on said second rust prevention film, comprising the steps of:

forming to adhere strongly a galvanized film having a lattice distortion of 0.02 to 0.35% of plated film measured by an X-ray diffractometer and a carbon content of 0.01 to 0.07 mass % in plated film, by plating on a surface of a metal substrate using a zinc cyanide bath of which caustic soda concentration is 50 to 160 g/L, zinc concentration is 10 to 30 g/L, a ratio of sodium cyanide concentration (g/L) to zinc concentration (g/L) is more than 3 and equal or inferior to 4, and to which a brightener is added, and washing the galvanized film with water;

next, forming a first rust prevention film mainly containing tannic acid to adhere strongly on the surface of the galvanized film by treating the surface of said galvanized film with a first treatment liquid containing tannic acid, and washing the formed first rust prevention film with water;

next, forming a second rust prevention film containing mainly metal ions and/or metal compounds on the upper portion of the first rust prevention film by treating with a second treatment liquid containing metal ions and/or metal compounds, and washing the formed second rust prevention film with water; and next, forming a third rust prevention film mainly containing tannic acid to adhere strongly on the surface of the second rust prevention film by treating with the first treatment liquid containing tannic acid, and washing the formed third rust prevention film with water and drying the formed third rust prevention film.

* * * * *

UNITED STATES PATENT AND TRADEMARK OFFICE

CERTIFICATE OF CORRECTION

PATENT NO. : 6,749,953 B1 
DATED : June 15, 2004
INVENTOR(S) : Akira Sawatari et al.

It is certified that error appears in the above-identified patent and that said Letters Patent is hereby corrected as shown below:

Column 2,
Line 43, “still further” should read -- further --;
Line 48, “to more” should read -- is more --;

Column 4,
Line 36, “$\beta 2+\tan 2\ \theta\lambda/\varepsilon x\beta/\tan\theta\ \sin\theta+\eta 2$” should read
-- $\beta 2 + \tan 2\ \theta=\lambda/\varepsilon\times\beta/\tan\theta\sin\theta + \eta 2$ --;

Column 9,
Line 38, “Lattice Distortion Measurement” should read -- (Lattice Distortion Measurement) --;

Column 14,
Lines 41-42, “metal ions and/or metal compounds” should read -- at least one metal ion and/or at least one metal compound --;
Lines 52-58, should read as follows:
-- 3. The galvanized product of claim 1, wherein said at least one metal ion is selected from the group consisting of Mo, V, Ti, W, and Zr. --;

Column 15,
Lines 1-12, should read as follows:
-- 6. The galvanized product of claim 5 wherein:
said metal substrate has a surface of a metal selected from the group consisting of iron base material, zinc, nickel, aluminum, magnesium, copper and alloys of two or more metals selected from the group consisting of zinc, nickel, aluminum, magnesium, and copper; and
said at least one metal ion is selected from the group consisting of Mo, V, Ti, W, and Zr. --

Signed and Sealed this

Fourteenth Day of June, 2005

JON W. DUDAS
*Director of the United States Patent and Trademark Office*